US008430167B2

(12) United States Patent
McD. Cameron

(10) Patent No.: US 8,430,167 B2
(45) Date of Patent: Apr. 30, 2013

(54) ARCUATE CONTROL LINE ENCAPSULATION

(75) Inventor: John A. McD. Cameron, The Woodlands, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 339 days.

(21) Appl. No.: 12/826,364

(22) Filed: Jun. 29, 2010

(65) Prior Publication Data

US 2011/0315391 A1 Dec. 29, 2011

(51) Int. Cl.
*E21B 17/00* (2006.01)

(52) U.S. Cl.
USPC ..... 166/335; 166/351; 166/360; 166/380; 166/241.6; 166/242.3; 277/332

(58) Field of Classification Search ..... 166/335, 166/339, 341, 351, 360, 367, 368, 378–380, 166/241.6, 242.3; 277/331, 332
See application file for complete search history.

(56) References Cited

U.S. PATENT DOCUMENTS 3,331,946 A * 7/1967 Bilbro ..... 219/535
3,844,345 A * 10/1974 Evans et al. ..... 166/72
3,949,189 A * 4/1976 Bilbro et al. ..... 392/468
3,975,617 A * 8/1976 Othmer ..... 392/469
4,068,966 A * 1/1978 Johnson et al. ..... 403/397
4,123,837 A * 11/1978 Horner ..... 29/890.045
4,203,186 A * 5/1980 Horner ..... 29/890.045
4,262,703 A * 4/1981 Moore et al. ..... 138/115
4,314,144 A * 2/1982 Wojtecki et al. ..... 219/528
4,346,277 A * 8/1982 Wojtecki et al. ..... 219/528
4,366,356 A * 12/1982 Ando ..... 219/629
4,569,392 A * 2/1986 Peterman ..... 166/65.1
5,013,005 A * 5/1991 Nance ..... 251/1.3
5,086,836 A * 2/1992 Barth et al. ..... 165/164
6,135,209 A * 10/2000 Uhlenkott ..... 166/369
6,302,213 B1 * 10/2001 Uhlenkott ..... 166/369
6,513,597 B2 * 2/2003 Uhlenkott ..... 166/369
6,668,934 B2 * 12/2003 Uhlenkott ..... 166/369
6,810,916 B2 * 11/2004 Thompson ..... 138/32
6,834,716 B2 * 12/2004 Uhlenkott ..... 166/65.1
6,988,555 B2 * 1/2006 Uhlenkott ..... 166/369
7,282,638 B2 * 10/2007 Karlsen et al. ..... 174/15.1
7,311,151 B2 * 12/2007 Chitwood et al. ..... 166/367
7,322,415 B2 * 1/2008 de St. Remey ..... 166/302
7,568,526 B2 * 8/2009 de St. Remey et al. ..... 166/302
7,992,632 B2 * 8/2011 Bornes et al. ..... 166/61

* cited by examiner

*Primary Examiner* — Matthew Buck
(74) *Attorney, Agent, or Firm* — Pillsbury Winthrop Shaw Pittman LLP

(57) ABSTRACT

Control lines on the outer surface of a tubular disposed within a drilling riser casing may be encapsulated to facilitate formation of a seal in an annular space defined by an inner surface of the drilling riser casing and an outer surface of the tubular. More specifically, an encapsulation body may be configured to at least partially encase control lines. The encapsulation body may include a first surface and a second surface. The first surface may have an arcuate shape that corresponds to the outer surface of the tubular to facilitate formation of a seal between the first surface of the encapsulation body and the outer surface of the tubular when the first surface of the encapsulation body abuts the outer surface of the tubular. The second surface may be shaped to provide a geometrically continuous periphery about the tubular and the encapsulation body when the first surface of the encapsulation body abuts the outer surface of the tubular.

15 Claims, 4 Drawing Sheets

ARCUATE CONTROL LINE ENCAPSULATION

FIELD OF THE INVENTION

The invention relates to control lines encapsulated so as to facilitate formation of a seal in an annular space defined by an inner surface of a drilling riser casing and an outer surface of a tubular when the encapsulated control lines are disposed on the outer surface of the tubular.

BACKGROUND OF THE INVENTION

At or near the surface of an extraction well (e.g., an oil or gas well), one or more large safety valves known as blowout preventers (BOPs) are used by drilling crews to seal off a wellbore. For example, if underground pressure forces oil or gas into the wellbore, a drilling crew can close the BOP(s) remotely (e.g., via hydraulic actuators) to forestall a blowout, and regain control of the wellbore. Once this is accomplished, drilling mud density within the wellbore can be increased until adequate fluid pressure is placed on an influx zone, and the BOP(s) can be opened for operations to resume. BOPs exist in a variety of styles, sizes, and pressure ratings. Some BOPs can effectively close over an open wellbore (e.g., blind ram), while others are fitted with hardened steel shearing surfaces that can actually cut through drillpipe (e.g., shear ram). Some BOPs are designed to seal around tubular components disposed within the wellbore (e.g., annular BOP).

A well completion generically describes an assembly of downhole tubulars and equipment required to enable safe and efficient production from an extraction well. Control lines may be positioned on the outer surface of such tubulars to convey energy and/or information between the surface and various downhole locations. When running or retrieving well completions with control lines, the pressure differential rating of annular BOPs may be drastically reduced as it is difficult to obtain an effective seal across the abrupt edges and recesses of conventional control line encapsulation profiles. If an effective and sufficient seal cannot be obtained, activation of blind and/or shear ram BOPs may be required, which can pose a major hazard to personnel on a rig floor and/or result in a costly recovery operation or loss of the wellbore.

SUMMARY

One aspect of the invention relates to an apparatus configured to encapsulate control lines on the outer surface of a tubular disposed within a drilling riser casing to facilitate formation of a seal in an annular space defined by an inner surface of the drilling riser casing and an outer surface of the tubular. The apparatus may include an encapsulation body configured to at least partially encase the one or more control lines. The encapsulation body may include a first surface and a second surface. The first surface may have an arcuate shape that corresponds to the outer surface of the tubular to facilitate formation of a seal between the first surface of the encapsulation body and the outer surface of the tubular when the first surface of the encapsulation body abuts the outer surface of the tubular. The second surface may be shaped to provide a geometrically continuous periphery about the tubular and the encapsulation body when the first surface of the encapsulation body abuts the outer surface of the tubular.

Another aspect of the invention relates to a system, which may include a drilling riser casing of a well (e.g., extraction well, injection well, dump flood well, monitoring well, and/or other well), a tubular disposed within the drilling riser casing such that an annular space is defined by an inner surface of the drilling riser casing and an outer surface of the tubular, one or more control lines positioned on the outer surface of the tubular, an encapsulation body configured to at least partially encase the one or more control lines, a sealing apparatus, and an activation apparatus. The one or more control lines may be configured to communicate one or more of mechanical energy, electrical energy, electromagnetic energy, or information between a geological surface vicinity and a downhole location. The encapsulation body may include a first surface and a second surface. The first surface may have an arcuate shape that corresponds to the outer surface of the tubular to facilitate formation of a seal between the first surface of the encapsulation body and the outer surface of the tubular when the first surface of the encapsulation body abuts the outer surface of the tubular. The second surface may be shaped to provide a geometrically continuous periphery about the tubular and the encapsulation body when the first surface of the encapsulation body abuts the outer surface of the tubular. The sealing apparatus may be configured to facilitate formation of a seal in the annular space defined by the inner surface of the drilling riser casing and the outer surface of the tubular. The sealing apparatus may include an annular barrier device configured to occupy the annular space when activated. The activation apparatus may be configured to activate the sealing apparatus, wherein activating the sealing apparatus includes inflating or manipulating the annular barrier device of the sealing apparatus to seal the annular space defined by the inner surface of the drilling riser casing and the outer surface of the tubular.

Yet another aspect of the invention relates to a method for forming a seal in an annular space defined by an inner surface of a drilling riser casing and an outer surface of a tubular disposed within the drilling riser casing when control lines are positioned on the outer surface of the tubular. The method may include at least partially encapsulating one or more control lines with an encapsulation body. The encapsulation body may include a first surface and a second surface. The first surface may have an arcuate shape that corresponds to the outer surface of the tubular to facilitate formation of a seal between the first surface of the encapsulation body and the outer surface of the tubular when the first surface of the encapsulation body abuts the outer surface of the tubular. The second surface may be shaped to provide a geometrically continuous periphery about the tubular and the encapsulation body when the first surface of the encapsulation body abuts the outer surface of the tubular. The method may include activating a sealing apparatus configured to facilitate formation of a seal in the annular space defined by the inner surface of the drilling riser casing and the outer surface of the tubular. The sealing apparatus may include an annular barrier device configured to occupy the annular space when activated.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
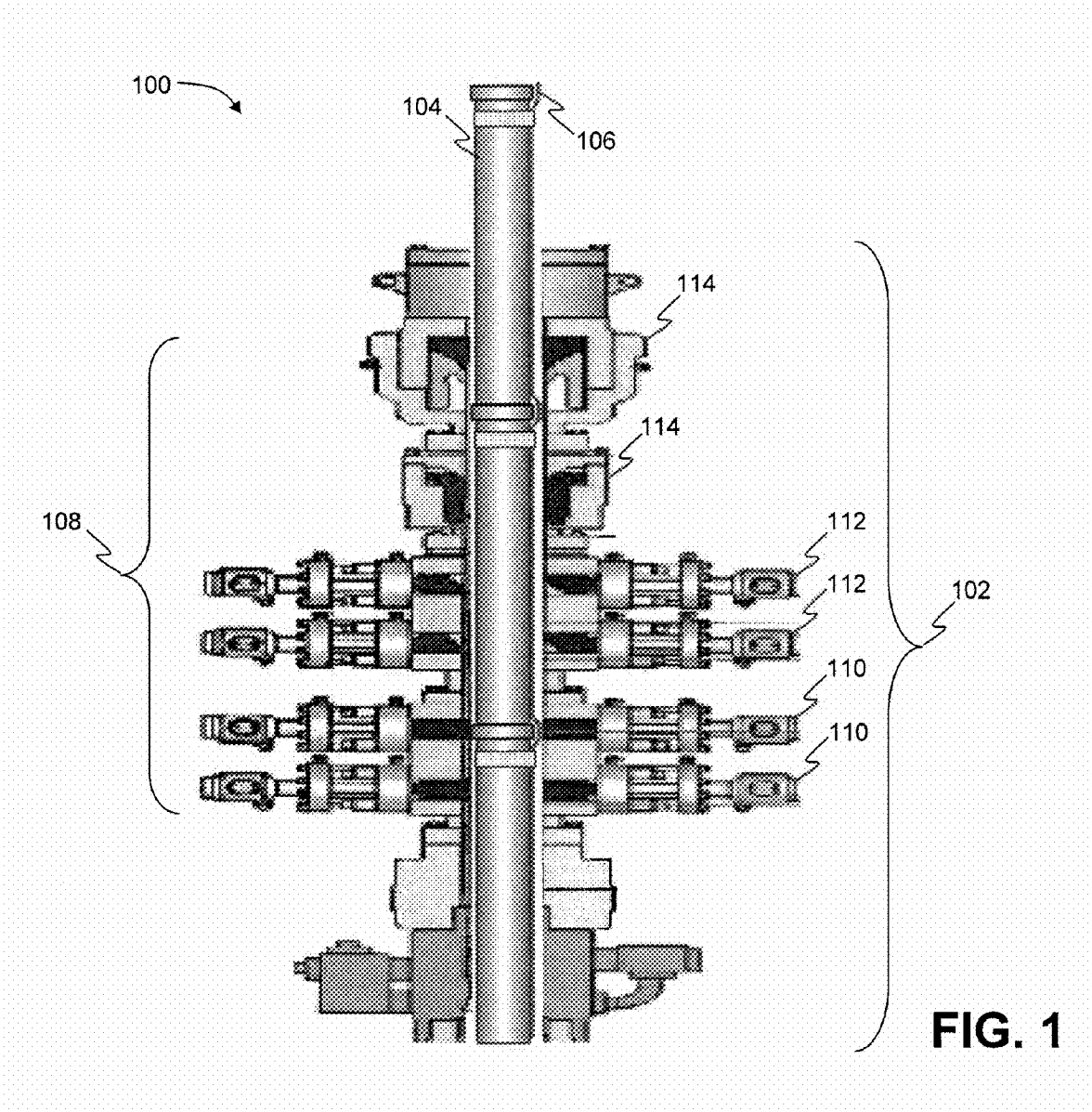
FIG. 1 illustrates a system in which one or more embodiments of the present invention may be practiced.

FIG. 1 illustrates a system 100 in which one or more embodiments of the present invention may be practiced. The system 100 may be implemented at a well (e.g., extraction well, injection well, dump flood well, monitoring well, and/or other well). Exemplary embodiments of the present invention facilitate encapsulating control lines on the outer surface of a tubular disposed within a drilling riser casing such that a seal may be formed in an annular space defined by an inner surface of the drilling riser casing and an outer surface of the tubular. By facilitating an effective and/or sufficient seal when control lines are present, exemplary embodiments reduce the likelihood of activation of blind and/or shear ram BOPs and, thereby, reduce the likelihood of major hazards to personnel on a rig floor, costly recovery operations, and/or loss of the well-bore. In one embodiment, the system 100 includes a drilling riser 102, a tubular 104, one or more control lines 106, sealing apparatus 108, activation apparatus (depicted as part of the sealing apparatus 108), and/or other components.

The drilling riser 102 is a conduit that provides a temporary extension of a sub-sea well (e.g., extraction well, injection well, dump flood well, monitoring well, and/or other well) to a surface drilling facility. Generally speaking, drilling risers may be categorized into two types: marine drilling risers and tie-back drilling risers. Marine drilling risers are used with sub-sea BOPs, and are generally used by floating drilling vessels. Tie-back drilling risers are used with surface BOPs, and are generally deployed from fixed platforms or very stable floating platforms like a spar or tension leg platform. The drilling riser 102 may be considered a temporary extension of the wellbore to the surface.

The tubular 104 may include production tubing and/or other tubulars disposed within the drilling riser 102. Production tubing is a wellbore tubular used to produce reservoir fluids (e.g., oil and/or gas). Production tubing may be assembled with other completion components to make up a production string. Production tubing for a given completion is generally selected to be compatible with the wellbore geometry, reservoir production characteristics, the reservoir fluids, and/or other production factors.

The control lines 106 may be positioned on the outer surface of the tubular 104. The control lines 106 may be configured to convey or communicate one or more of mechanical energy, electrical energy, electromagnetic energy, and/or information between a geological surface vicinity and a downhole location. For example, one or more of the control lines 106 may convey hydraulic fluid used to operate downhole completion equipment such as, for example, a surface controlled subsurface safety valve. One or more of the control lines 106 may include a mechanical linkage configured to manipulate some downhole mechanism or device. The control lines 106 may include data cables (e.g., fiber optic and/or electrical) to transmit information to and from pressure gauges and/or other downhole instrumentation. Electrical power may be supplied downhole by the control lines 106. One or more of the control lines 106 may be encased by an encapsulation body, as described further in connection with FIGS. 2 and 3.

The sealing apparatus 108 may include one or more BOPs and/or other sealing mechanisms. In some embodiments, the sealing apparatus 108 is positioned at the top of a well at the drilling riser 102. The sealing apparatus 108 may be activated (i.e., closed), for example, if the drilling crew loses control of formation fluids. By activating the sealing apparatus 108, the drilling crew can regain control of the reservoir, and procedures can then be initiated to increase the mud density until it is possible to open the sealing apparatus 108 and retain pressure control of the formation. As mentioned above, BOPs exist in a variety of styles, sizes, and pressure ratings. Examples of types of BOPs include blind ram BOPs 110 that effectively close over an open wellbore, shear ram BOPs 112 that are fitted with hardened steel shearing surfaces to actually cut through drillpipe when activated, variable ram BOPs (not depicted in FIG. 1), annular BOPs 114 that are designed to seal around tubular components in the well (e.g., the tubular 104), and/or other blowout preventers. While the sealing apparatus 108 is generally described herein in the context of BOPs, other sealing arrangements are contemplated and are within the scope of the present invention.

In one embodiment, the sealing apparatus 108 is configured to facilitate formation of a seal in an annular space defined by the inner surface of the drilling riser 102 and the outer surface of the tubular 104. This may be achieved, for example, by one or more of the annular BOPs 114. Each of the annular BOPs 114 may include a valve configured to control wellbore fluids. In this type of valve, a sealing element may include an annular barrier device configured to occupy the annular space when activated. The annular barrier device may resemble a large rubber donut or toroid, which may be squeezed inward to seal on either a pipe (e.g., the tubular 104) or an open hole. The ability to seal on a variety of pipe sizes is one advantage the annular BOPs 114 has over some other types of BOPs.

The activation apparatus (depicted as part of the sealing apparatus 108) may be configured to activate (i.e., close) and/or deactivate (i.e., open) one or more of the sealing apparatus 108. Activating the sealing apparatus may include inflating, mechanically squeezing, and/or otherwise manipulating the annular barrier device of the annular BOPs 114 to seal the annular space defined by the inner surface of the drilling riser 102 and the outer surface of the tubular 104. In some embodiments, the activation apparatus may include one or more hydraulic actuators configured to activate and/or deactivate the sealing apparatus 108.

Figure 2A:
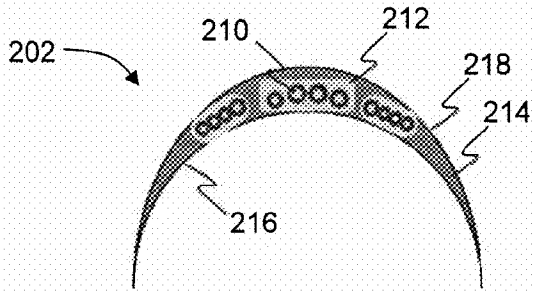
FIGS. 2A and 2B respectively illustrate an encapsulation body and exemplary placement of that encapsulation body on an outer surface of a tubular disposed within a drilling riser casing, in accordance with one or more embodiments of the invention.
Figure 2B:
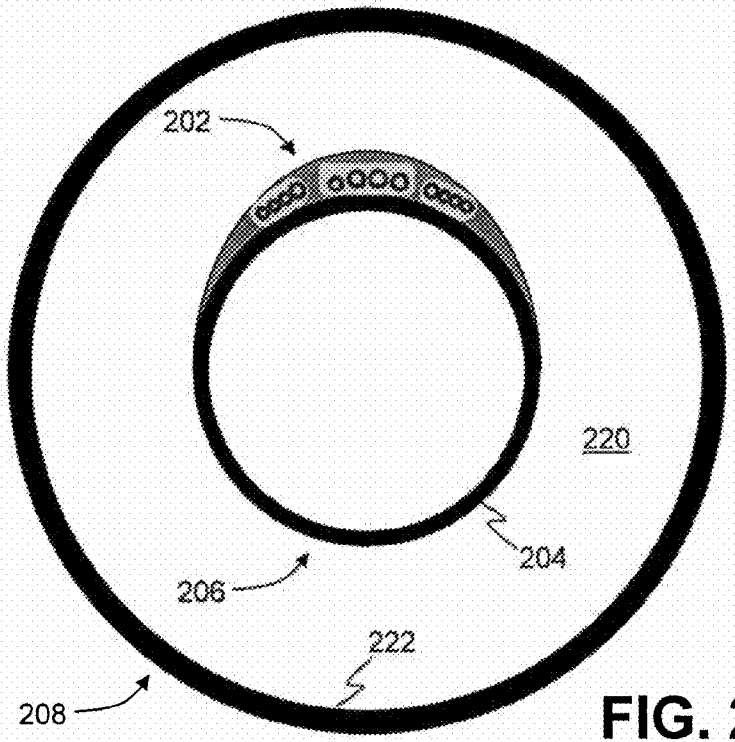

FIGS. 2A and 2B respectively illustrate an encapsulation body 202 and exemplary placement of the encapsulation body 202 on an outer surface 204 of a tubular 206 disposed within a drilling riser casing 208, in accordance with one or more embodiments of the invention. The encapsulation body 202 is configured to at least partially encase the one or more control lines 210. In some embodiments, the encapsulation body 202 may include one or more hard encapsulations 212 that encases the control lines 210, and a deformable encapsulation 214 that encases the hard encapsulations 212. The hard encapsulations 212 may serve to protect the control lines 210, while the deformable encapsulations 214 may serve to form a seal with a BOP, the outer surface 204 of the tubular 206, and/or other surfaces. The hard encapsulations 212 may be formed, for example, of high density polyethylene (HDPE), polyvinyl chloride (PVC), polyvinylidene fluoride (PVDF), other polymeric compounds, one or more metals, and/or other materials. The deformable encapsulation 214 may be formed, for example, of neoprene, nitriles, fluoroelastomers (FKM) and/or perfluoroelastomers (FFKM) (see, e.g., "ASTM D1418-10: Standard for Rubber and Rubber Lattices-Nomenclature"), polytetrafluoroethylene (PTFE), polyether ether ketone (PEEK), other elastomeric and/or thermoplastic compounds, and/or other materials. In some embodiments, the hard encapsulations 212 may be omitted from the encapsulation body 202. According to some embodiments, a deformable material may only be included on the first surface 216, the second surface 218, and/or another surface of the encapsulation body 202.

The encapsulation body 202 may include a first surface 216 and a second surface 218. The first surface 216 may have an arcuate shape that corresponds to the outer surface 204 of the tubular 206. Such an arcuate shape may facilitate formation of a seal between the first surface 216 of the encapsulation body 202 and the outer surface 204 of the tubular 206 when the first surface 216 of the encapsulation body 202 abuts the outer surface 204 of the tubular 206 (see, e.g., FIG. 2B). The second surface 218 may be shaped to provide a geometrically continuous periphery about the tubular 206 and the encapsulation body 202 when the first surface 216 of the encapsulation body 202 abuts the outer surface 204 of the tubular 206 (see, e.g., FIG. 2B). By providing the geometrically continuous periphery about the tubular 206 and the encapsulation body 202, an annular BOP or other sealing mechanism (not depicted in FIGS. 2A and 2B) may form a seal when activated in the annular space 220 defined by the inner surface 222 of the drilling riser casing 208 and the outer surface 204 of the tubular 206. It is noteworthy that, in some embodiments, one or more surfaces of the encapsulation body 202 may be shaped so as to correspond to a specific BOP configuration to provide effective and/or sufficient sealing therewith.

FIGS. 3A, 3B, 3C, and 3D illustrate an encapsulation body 302 and installation steps thereof on an outer surface 304 of a tubular 306 (depicted in FIG. 3 as a section of a tubular), in accordance with one or more embodiments of the invention. The encapsulation body 302 may encase one or more control lines 308. The encapsulation body 302 may be formed of a hard material, a deformable material, and/or a combination thereof. A deformable channel 310 may be configured to receive and/or encase (partially or wholly) the encapsulation body 302. The deformable channel 310 may be formed of a deformable material such that a seal can be formed between the outer surface 304 of the tubular 306 and the deformable channel 310.

Figure 3A:
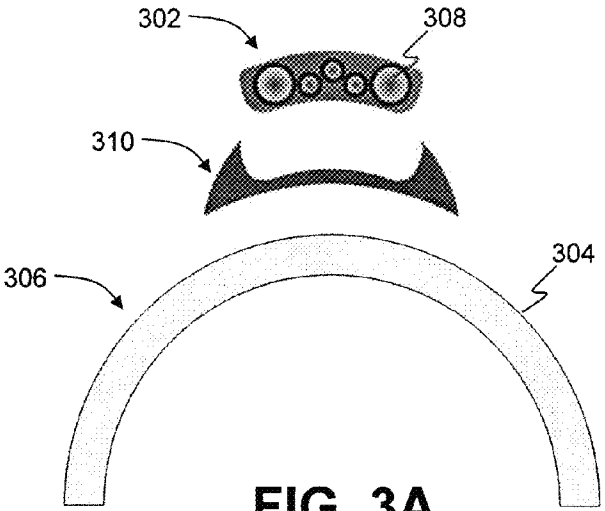
FIGS. 3A, 3B, 3C, and 3D illustrate an encapsulation body and installation steps thereof on an outer surface of a tubular, in accordance with one or more embodiments of the invention.
Figure 3B:
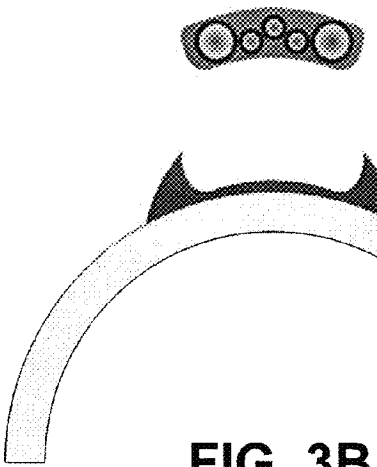
Figure 3C:
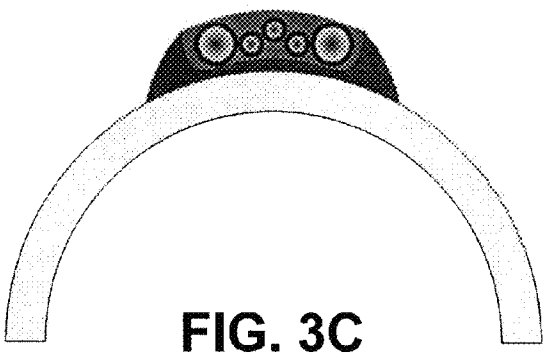
Figure 3D:
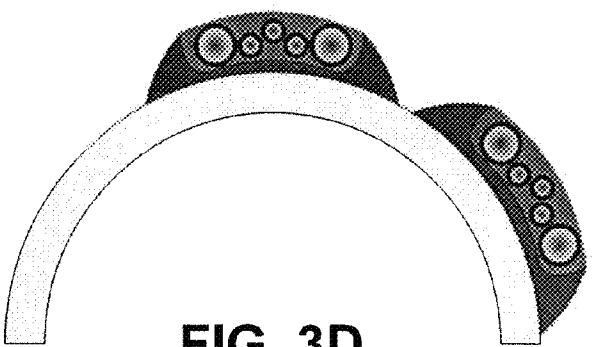

In FIG. 3A, the encapsulation body 302 and the deformable channel 310 are not installed on the tubular 306. In FIG. 3B, the deformable channel 310 is placed on the outer surface 304 of the tubular 306. In FIG. 3C, the encapsulation body 302 is received and partially encased by the deformable channel 310. In FIG. 3D, an additional encapsulation body similar to the encapsulation body 302 is placed on the outer surface 304 of the tubular 306. It is noteworthy that any number of encapsulation bodies (e.g., the encapsulation body 202 and/or the encapsulation body 302) may be placed on the outer surface of a tubular (e.g., the tubular 206 and/or the tubular 306), in accordance with various embodiments. The particular shapes and configurations of the encapsulation body 302 and the deformable channel 310 are not intended to be limiting as other shapes and configurations are contemplated and are within the scope of the present invention.

Figure 4:
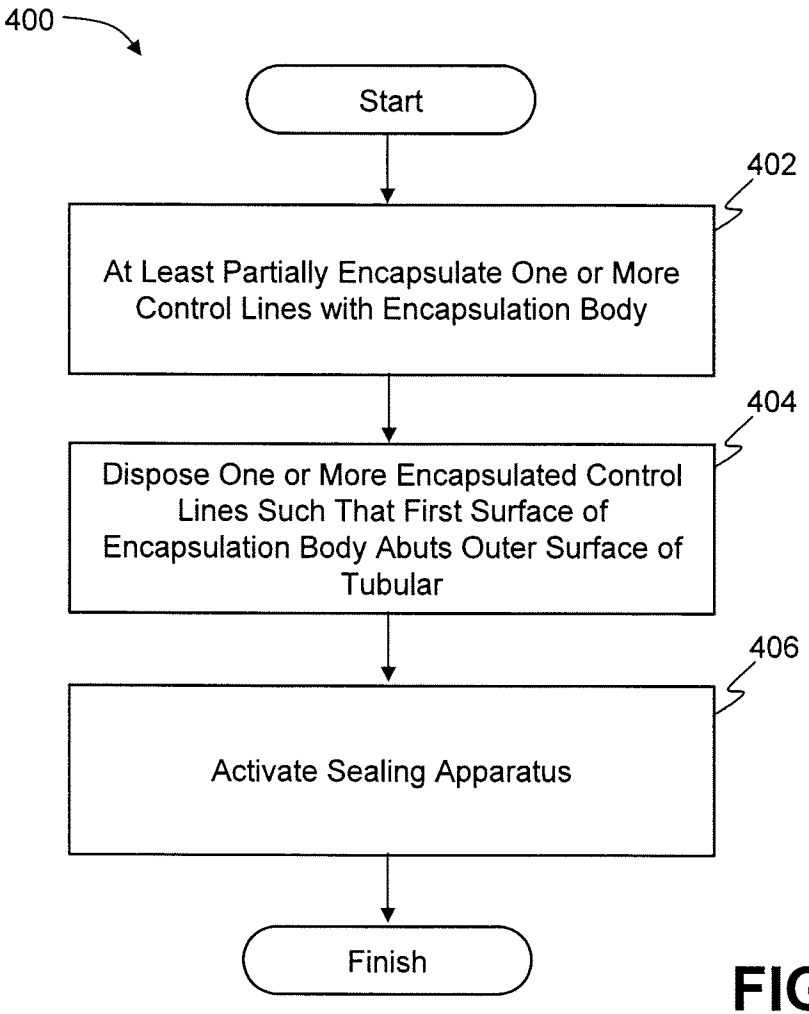
FIG. 4 illustrates a method for forming a seal in an annular space defined by an inner surface of a drilling riser casing and an outer surface of a tubular disposed within the drilling riser casing, in accordance with one or more embodiments of the invention.

FIG. 4 illustrates a method 400 for forming a seal in an annular space defined by an inner surface of a drilling riser casing and an outer surface of a tubular disposed within the drilling riser casing, in accordance with one or more embodiments of the invention. The operations of the method 400 presented below are intended to be illustrative. In some embodiments, the method 400 may be accomplished with one or more additional operations not described, and/or without one or more of the operations discussed. Additionally, the order in which the operations of the method 400 are illustrated in FIG. 4 and described below is not intended to be limiting.

In some embodiments, the method 400 may be partially or wholly implemented by one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of the method 400 in response to instructions stored electronically on an electronic storage medium. The electronic storage medium may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The one or more processing devices may include one or more devices configured through hardware, firmware, and/or software to be specifically designed for execution of one or more of the operations of the method 400.

At an operation 402, one or more control lines are at least partially encapsulated with an encapsulation body. The encapsulation body may include a first surface and a second surface. The first surface may have an arcuate shape that corresponds to the outer surface of a tubular. The second surface may be shaped to provide a geometrically continuous periphery about the tubular and the encapsulation body when the first surface of the encapsulation body abuts the outer surface of the tubular.

At an operation 404, the encapsulated one or more control lines are disposed such that the first surface of the encapsulation body abuts the outer surface of the tubular. Since the first surface of the encapsulation body may have an arcuate shape that corresponds to the outer surface of the tubular, a seal may be formed between the first surface of the encapsulation body and the outer surface of the tubular when the first surface of the encapsulation body abuts the outer surface of the tubular.

At an operation 406, a sealing apparatus is activated. The sealing apparatus may be configured to facilitate formation of a seal in the annular space defined by the inner surface of a drilling riser casing and the outer surface of the tubular. The sealing apparatus may include an annular barrier device configured to occupy the annular space when activated.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. Apparatus configured to encapsulate control lines on the exterior of a tubular disposed within a drilling riser casing to facilitate formation of a seal in an annular space defined by an inner surface of the drilling riser casing and an outer surface of the tubular, the apparatus comprising:

an encapsulation body configured to at least partially encase the one or more control lines, the encapsulation body comprising:

a first surface having an arcuate shape that corresponds to the outer surface of the tubular to facilitate formation of a seal between the first surface of the encapsulation body and the outer surface of the tubular when the first surface of the encapsulation body abuts the outer surface of the tubular; and a second surface shaped to provide a geometrically continuous periphery about the tubular and the encapsulation body when the first surface of the encapsulation body abuts the outer surface of the tubular; and an encapsulation member configured to fully encase the one or more control lines, the encapsulation member at least partially encased by the encapsulation body, wherein the second surface of the encapsulation body includes a groove, and the encapsulation member is disposed within the groove so as to maintain the geometrically continuous periphery about the tubular and the encapsulation body when the first surface of the encapsulation body abuts the outer surface of the tubular.

2. The apparatus of claim 1, wherein the encapsulation body is formed at least partially by a deformable material.

3. The apparatus of claim 2, wherein the deformable material is an elastomeric material.

4. The apparatus of claim 1, wherein the first surface of the encapsulation body comprises a deformable material.

5. The apparatus of claim 1, wherein the encapsulation member is formed of a material that is harder than a material forming the encapsulation body.

6. The apparatus of claim 1, wherein the encapsulation member is fully encased by the encapsulation body.

7. A system comprising:

a drilling riser casing of a well;

a tubular disposed within the drilling riser casing such that an annular space is defined by an inner surface of the drilling riser casing and an outer surface of the tubular;

one or more control lines positioned on the outer surface of the tubular, the one or more control lines configured to communicate one or more of mechanical energy, electrical energy, electromagnetic energy, or information between a geological surface vicinity and a downhole location;

an encapsulation body configured to at least partially encase the one or more control lines, the encapsulation body comprising:

a first surface having an arcuate shape that corresponds to the outer surface of the tubular to facilitate formation of a seal between the first surface of the encapsulation body and the outer surface of the tubular when the first surface of the encapsulation body abuts the outer surface of the tubular; and a second surface shaped to provide a geometrically continuous periphery about the tubular and the encapsulation body when the first surface of the encapsulation body abuts the outer surface of the tubular;

an encapsulation member configured to fully encase the one or more control lines, the encapsulation member at least partially encased by the encapsulation body, wherein the second surface of the encapsulation body includes a groove, and the encapsulation member is disposed within the groove so as to maintain the geometrically continuous periphery about the tubular and the encapsulation body when the first surface of the encapsulation body abuts the outer surface of the tubular;

a sealing apparatus configured to facilitate formation of a seal in the annular space defined by the inner surface of the drilling riser casing and the outer surface of the tubular, the sealing apparatus comprising an annular barrier device configured to occupy the annular space when activated; and an activation apparatus configured to activate the sealing apparatus, wherein activating the sealing apparatus includes inflating or manipulating the annular barrier device of the sealing apparatus to seal the annular space defined by the inner surface of the drilling riser casing and the outer surface of the tubular.

8. The system of claim 7, wherein the encapsulation body is formed at least partially by a deformable material.

9. The system of claim 8, wherein the deformable material is an elastomeric material.

10. The system of claim 7, wherein the first surface of the encapsulation body comprises a deformable material.

11. The system of claim 7, wherein the encapsulation member is formed of a material that is harder than a material forming the encapsulation body.

12. The system of claim 7, wherein the encapsulation member is fully encased by the encapsulation body.

13. A method for facilitating formation of a seal in an annular space defined by an inner surface of a drilling riser casing and an outer surface of a tubular disposed within the drilling riser casing when control lines are positioned on the outer surface of the tubular, the method comprising:

at least partially encapsulating one or more control lines with an encapsulation body comprising:

a first surface having an arcuate shape that corresponds to the outer surface of the tubular to facilitate formation of a seal between the first surface of the encapsulation body and the outer surface of the tubular when the first surface of the encapsulation body abuts the outer surface of the tubular; and a second surface shaped to provide a geometrically continuous periphery about the tubular and the encapsulation body when the first surface of the encapsulation body abuts the outer surface of the tubular;

fully encasing the one or more control lines using an encapsulation member; and at least partially disposing the encapsulation member within the encapsulation body, wherein the second surface of the encapsulation body includes a groove, and the encapsulation member is disposed within the groove so as to maintain the geometrically continuous periphery about the tubular and the encapsulation body when the first surface of the encapsulation body abuts the outer surface of the tubular;

wherein activating a sealing apparatus facilitates formation of a seal in the annular space defined by the inner surface of the drilling riser casing and the outer surface of the tubular, the sealing apparatus comprising an annular barrier device configured to occupy the annular space when activated.

14. The method of claim 13, wherein the encapsulation body is formed at least partially by a deformable material.

15. The method of claim 13, wherein the encapsulation member is formed of a material that is harder than a material forming the encapsulation body.

* * * * *